United States Patent [19]

Riedl

[11] Patent Number: 4,768,244

[45] Date of Patent: Sep. 6, 1988

[54] SLAT-GRATE FURNITURE SPRING

[76] Inventor: Georg Riedl, Hauptstrasse 10, D-3423 Andrä-Wördern, Austria

[21] Appl. No.: 20,373

[22] Filed: Mar. 2, 1987

[30] Foreign Application Priority Data

Feb. 28, 1986 [AT] Austria ..... 521/86

[51] Int. Cl.[4] ..... A47C 23/06; A47C 23/08

[52] U.S. Cl. ..... 5/237; 5/239; 5/241

[58] Field of Search ..... 5/236.12, 237–239, 5/241, 244

[56] References Cited

U.S. PATENT DOCUMENTS

| | | | |
|---|---|---|---|
| 83,001 | 10/1868 | Smith | 5/241 |
| 97,386 | 11/1869 | Gardner | 5/241 |
| 132,422 | 10/1872 | Trissler | 5/241 |
| 160,809 | 3/1875 | Bennett | 5/237 |
| 508,517 | 11/1893 | Harrison | 5/238 |

FOREIGN PATENT DOCUMENTS

| | | | |
|---|---|---|---|
| 0056428 | 7/1982 | European Pat. Off. . | |
| 3439275 | 11/1985 | Fed. Rep. of Germany . | |
| WO8301563 | 5/1983 | PCT Int'l Appl. . | |
| 466793 | 6/1937 | United Kingdom | 5/238 |

*Primary Examiner*—Michael F. Trettel
*Attorney, Agent, or Firm*—Herbert Dubno

[57] ABSTRACT

A slat-grate furniture spring in which carrying elements spaced apart along each longitudinal member of a support frame are located in gaps between resilient slats which are spaced apart and have carrying elements on their undersides. Elastic strands are threaded through the carrying elements alternating between a carrying element on the frame and a carrying element on a slat.

9 Claims, 1 Drawing Sheet

SLAT-GRATE FURNITURE SPRING

FIELD OF THE INVENTION

My present invention relates to a slat-grate furniture spring and, more particularly, to a furniture spring of the type in which a plurality of spring-action slats, generally of wood, form a supporting surface for cushions, a mattress or the like in an article of furniture.

BACKGROUND OF THE INVENTION

To form a slat grate or similar structure for supporting a mattress of cushions of a bed or other article of furniture, it is known to provide a plurality of spring-action slats which are nailed to bands with equidistant spacing, the bands being braced against members of a support frame.

In other constructions, slats which are supported on a frame and are intended to provide a resilient support in turn, for the mattress or cushions of a bed or sofa, for example, or some other article of furniture, can have rubber caps fitted onto their ends and connected by elastic intermediate members to the members of the support frame.

The European patent document EP-A No. 2 122 957 discloses a slat grate with resilient slats on the ends of which synthetic resin caps are provided, these caps projecting into recesses in the longitudinal boards or members of the support frame.

Recesses are larger than the cross section of the resilient slats and have a bulging inner surface. This permits a rotatable mounting of the slats.

In European patent document A No. 1 56 428, a support body of elastic material is provided for the mounting of resilient slats of a slat grate on the lateral longitudinal members (cheeks or side boards) of a bed frame. The support bodies have indexing projections for connection with the bed frame which afford an elastic mounting of the slats.

It is also known from International patent document WO No. A1 83/1563 to provide a slat grate in which the slats are held in loops of a cable of fixed length. If one of these loops is enlarged because of the load applied to the corresponding slat, other loops are shortened. This allows the slat grate to accommodate itself to the shape of the body of an individual resting upon the grate without generating a resilient deformation of the grate.

Finally, mention may be made of an embodiment of a slat grate in which the resilient slats engage spring plates of metal at their respective ends. The spring action in the latter case is generally found to be unsatisfactory and the construction is expensive to fabricate.

In German Pat. No. 34 39 275, a slat grate is described in which the resilient slats are carried by elastic strands which can have their tension adjusted. The support of each slat is effected through flanges which are fixed at the end regions of each slat and which have shanks passing between the tines of a fork-like support member disposed directly beneath the respective slat. Here the flanges lie directly adjacent one another over the entire length of the grate and can tilt about respective symmetry axes.

This construction has also been found to be advantageous since a twisting of each slat is possible and adjacent slats can twist in opposite directions providing irregular contour to the supporting surface when the weight of the body of a user is applied thereto.

OBJECTS OF THE INVENTION

It is, therefore, the principal object of the present invention to provide an improved slat grate which avoids the drawbacks of the resilient slat structures previously described.

Another object of my invention is to provide an improved slat-grate furniture spring which is of simple construction, allows for resilient support of neighboring slats without requiring any particular twist or distortion thereof and in which the slat-mounting structure is of low cost.

SUMMARY OF THE INVENTION

These objects and others which will become more readily apparent hereinafter are attained, in accordance with the invention by providing the carrying elements of the longitudinal members of the support frame, i.e. on the inwardly facing cheeks of the boards forming these members, in spaced relation from the carrying elements of the slats which preferably extend the full width of the slats, the carrying elements of the frame being located in gaps between the slats with spacing from carrying elements of the slats. The elastic strands which are threaded through horizontal boards of the carrying elements of the slats on the longitudinal frame members on each side of the slat-grate furniture spring of the invention thus can pass through free space from carrying element to carrying element.

According to the invention, therefore, the slat-grate furniture spring of the invention comprises a support frame having a pair of longitudinal frame members bridged by a pair of transverse frame members, usually located at opposite ends of the frame, a plurality of mutually parallel spaced apart, preferably resilient slats having proximal to opposite ends thereof, respective carrying elements in the form of blocks on the underside of each slat pierced through horizontally transverse to each slat with a rectilinear bore through which a respective elastic (rubber) strand passes.

The blocks alternate with inwardly projecting carrying elements from the cheeks or longitudinal members of the frame which lie in gaps between the slats and hence in gaps between blocks forming the carrying elements of the slats.

The rubber strands are anchored to the frame at opposite ends thereof, either directly, e.g. by being braced against one of the transverse members, or through a tension-adjusting unit, e.g. a windlass provided at a respective end of the frame.

Since the bores through the blocks of the slats have a length equal to the width of the slats, the slats are held substantially horizontal even upon loading.

It has been found to be advantageous to offset on each side of the frame, the distance between a common axis of the bores of the carrying elements on the longitudinal frame members so that the respective rubber strand passes back and forth between the carrying elements of the slats and frame in an undulating pattern. This ensures a centering of the slats between the longitudinal members of the frame and tends to prevent a shifting of the slats in their respective longitudinal directions.

According to another feature of the invention beneath the carrying elements of the slats, parallel to the longitudinal members of the frame, at least one further rubber strand is provided in a spaced relationship to the end faces of the carrying elements of the slats so as to further influence the spring characteristics of the entire system. This further rubber strand can also have its tension adjusted by a tensioning means which can be similar to that used for tensioning the strands threaded through the carrying elements.

BRIEF DESCRIPTION OF THE DRAWING

The above and other objects, features and advantages of the present invention will become more readily apparent from the following description, reference being made to the accompanying drawing in which.

SPECIFIC DESCRIPTION

A slat-grate furniture spring according to the invention can be used in a bed frame to support a mattress, in lawn furniture to support cushions, in systems using mats and in sofas or the like to support seat cushions. In general it provides a surface adapted to support the body of a user.

The slat-grate furniture spring comprises a support frame 1 which is formed by a pair of longitudinal members 2, 3 in the form of wood boards, connected by transverse members 20 and 21, also in the form of wood boards.

A multiplicity of resilient slats 4 are spaced apart in mutually parallel relationship along the length of the spring and lie generally parallel to the transverse members 20 and 21 of the frame.

Figure 3:
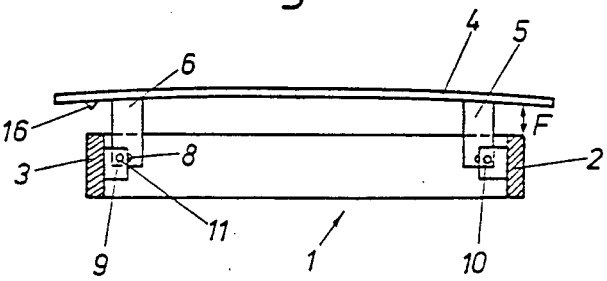
FIG. 3 is a section taken along the line III—III of FIG. 1.

As can be seen from FIG. 3, each of these slats comprises a thin, upwardly convex wood lath formed proximal to its ends with a pair of carrying elements 5, 6 in the form of wooden blocks bored through with holes 8 extending the full width of each slat, the thickness of each block 5, 6 being substantially equal to that of the slat 4 with which it is rigid.

Between the slats and at a distance from each slat so as to be located substantially midway in the gaps 22 between successive slats, holders 7 in the form of wood plates are rigidly mounted on the cheeks or flanks of members 2 and 3 projecting inwardly into the space surrounded by the frame.

These holding elements 7 are also bored through horizontally by holes 9.

On each side of the furniture spring, a respective rubber strand, cord or band, 10, 11 is threaded alternately through holes 8 and 9 of the carrying elements 7 and 5 or 6.

The rubber strands 10 and 11 at one end are fixed to the frame member 20, e.g. by knots 12 after passing through holes 23 in the member 20.

At the opposite ends, these bands are wound up on a windlass 14 which allows adjustable tensioning of the strands. The windlass 14 is rotatable in the members 2 and 3 adjacent member 21 of the frame, has a handle 24 enabling the windless to be rotated on a pin 25 which permits locking the windlass in its wound position. Another locking device for a rotatable member such is a ratchet and pawl arrangement, a worm and worm-wheel arrangement or even a lever and detent arrangement can be used.

Figure 2:
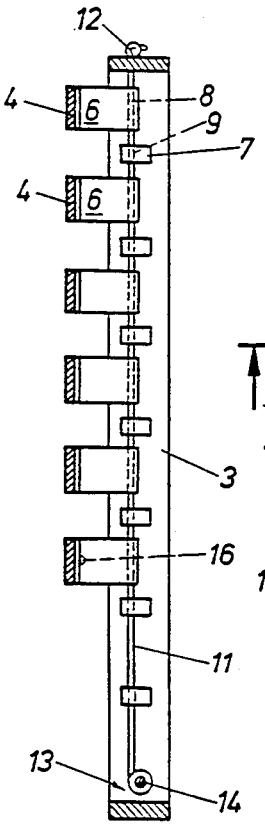
FIG. 2 is a cross-sectional view taken along the line II—II of FIG. 1.
Figure 1:
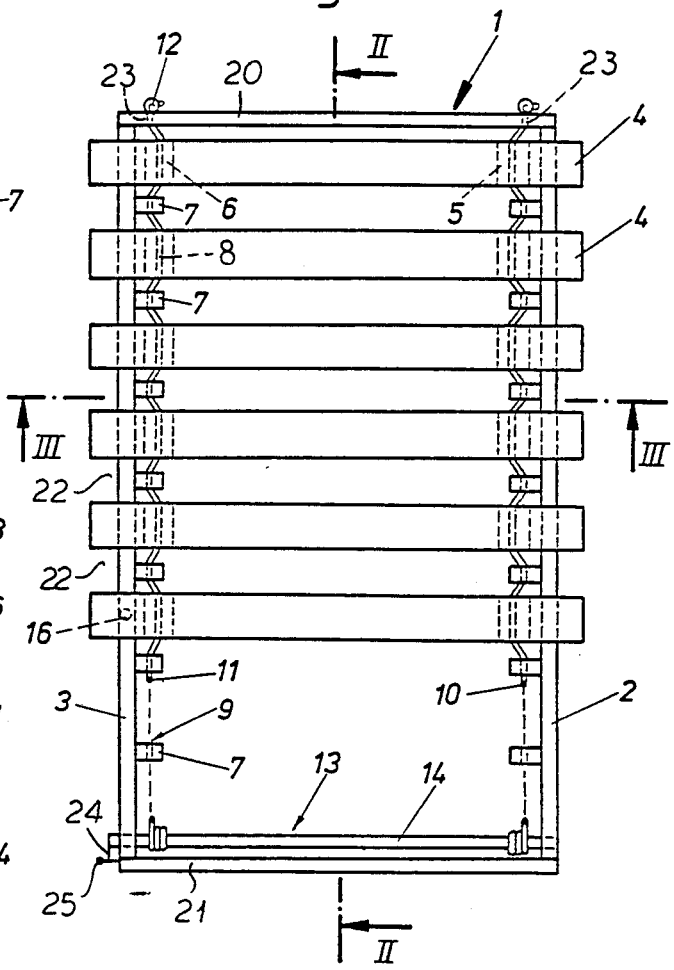
FIG. 1 is a plan view of a slat-grate furniture spring according to the invention, two slats of which have been removed to show underlying structure.

As is especially evident from FIGS. 1 and 3, the axes of the bores 8 and 9 do not coincide at each side of the spring. The axis of bores 8 is spaced from the axis of bores 9 so that the strands 10 and 11 threaded alternately through these bores on each side assumes a zigzag pattern clearly visible from FIG. 1. This ensures centering of the members 5 and 6 between two neighboring elements 7 and also limits longitudinal displacement of the slats.

When an individual rests upon the slats, the resulting loading gives rise to a bending of the slats carrying the load and a resilient stretching of the rubber strands 10 and 11. The spring action is thus a combination of the leaf-spring action of deformation of the slat and the spring action of the strands 10 and 11. If the spring forces are approximately equal, maximum lying comfort is achieved. It is possible to adjust the spring force contributed by the strands by corresponding adjustment of the device 13.

The spring displacement permitted by the strands 10 and 11 can be limited by stops, generally by the abutment of the slat against the upper edge of the members 2, 3. The maximum spring displacement is represented at F in FIG. 3.

Figure 4:
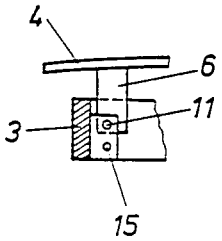
FIG. 4 is a detail section corresponding to a portion of the structure illustrated in FIG. 3 according to a modification or variant of the invention.

As can be seen from FIG. 4, a further elastic strand can span the element 7 beneath the lower ends of the blocks 5 and 6. This strand is represented at 15 and engages the blocks after part of the complete spring displacement is permitted, e.g. after a displacement of F/2. This increases the spring force contributed by the strands toward the end of the displacement.

The strands 15 can be adjustably tensioned by a device similar to or identical to the device 13 which has been illustrated.

The support frame 1 is, of course, insertable into a bedstead and the slats 4 can extend the full width of the bedstead and for that purpose may project beyond the members 2 and 3. If the ends of the slats overlap the sides of the bedstead, two beds can be brought practically together with little or no gap between the respective sets of slats.

This advantageous feature in use of the spring of the invention cannot be achieved with conventional slat-spring design where the end caps of the slats are engaged in recesses in the frame members of the support frame.

Of course elastic strands of other material than rubber can be used if desired. The diameters of the bores 8 and 9 are selected so that the strand passes with play through them. By clamping the strand in one or more of the carrying elements 7, I am able to adjust the spring characteristic in differing lying regions of the array of slats to the extent desired to accommodate, for example, separate spring forces for the head, torso, buttocks and upper leg and lower leg portions of the body.

As is also visible from FIG. 3, rubber or plastic cones 16 can be provided on the underside of the slats to engage the respective boards 2 or 3. They can be used to compensate for the inclination of the slats, to vary spring action, or the like. A cone of this type has been shown for only one of the slats.

I claim:

1. A slat-grate furniture spring, comprising:

a support frame having a pair of longitudinal frame members bridged by a pair of transverse frame members;

a plurality of mutually parallel spaced apart slats extending generally parallel to said transverse frame members supported on said frame, each of said slats having proximal to opposite ends thereof respective carrying elements, said longitudinal frame members having respective carrying elements received between the carrying elements of corresponding ends of said slats and alternating therewith in gaps between said slats;

respective elastic strands threaded through the carrying elements of said slats and said longitudinal members on each side of the spring;

means anchoring said strands to said frame at opposite ends of the spring; and further elastic strands disposed below said carrying elements of said slats and engageable with said carrying elements of said slats upon loading thereof to vary the resilient characteristic of said spring.

2. The slat-grate furniture spring defined in claim 1 wherein said elements of said slats are blocks extending substantially the full widths of the respective slats provided with bores through which the respective strands are threaded.

3. The slat-grate furniture spring defined in claim 1 wherein the carrying elements on said longitudinal frame members are boards extending inwardly from inner surfaces of said longitudinal frame members and formed with holes through which said strands are threaded.

4. The slat-grate furniture spring defined in claim 1 wherein said further strands are threaded through said carrying elements of said frame members.

5. The slat-grate furniture spring defined in claim 1 wherein at least some of said slats are provided on their undersides with elastic abutment members engageable against respective longitudinal members of said frame.

6. The slat-grate furniture spring defined in claim 1, further comprising means for adjusting tension of said strands.

7. The slat-grate furniture spring defined in claim 1 wherein said frame members, said slats and said carrying elements are composed of wood.

8. The slat-grate furniture spring defined in claim 1 wherein said strands are composed of rubber.

9. A slat-grate furniture spring, comprising:

a support frame having a pair of longitudinal frame members bridged by a pair of transverse frame members;

a plurality of mutually parallel spaced apart upwardly bowed slats extending generally parallel to said transverse frame members above said frame and of lengths such that said slats protrude beyond said longitudinal frame members on opposite sides of said support frame, each of said slats having proximal to opposite ends thereof but inwardly of the respective longitudinal frame members respective downwardly extending carrying elements, said longitudinal frame members having inwardly facing flanks provided with respective carrying elements received between the carrying elements of corresponding ends of said slats and alternating therewith in gaps between said slats;

respective elastic strands threaded through the carrying elements of said slats and said longitudinal members on each side of the spring; and respective means anchoring said strands to said frame at opposite ends of the spring, one of said means including a windlass having a horizontal axis and spanning said longitudinal frame members parallel to one of said transverse frame members and on which said strands are wound, said windlass being rotatable to control tension of said strands and being provided with means for locking the windlass in position.

* * * * *